United States Patent [19]

Miller

[11] Patent Number: 4,516,779

[45] **Date of Patent: * May 14, 1985**

[54] GOLF TRAINING AID

[75] Inventor: Gardner H. Miller, Albuquerque, N. Mex.

[73] Assignee: Trustroke International, Inc., Albuquerque, N. Mex.

[ * ] Notice: The portion of the term of this patent subsequent to Nov. 8, 2000 has been disclaimed.

[21] Appl. No.: 478,165

[22] Filed: Mar. 23, 1983

Related U.S. Application Data

[63] Continuation-in-part of Ser. No. 409,418, Aug. 19, 1982, Pat. No. 4,423,875, which is a continuation-in-part of Ser. No. 398,112, Jul. 14, 1982, Pat. No. 4,413,826.

[51] Int. Cl.[3] ..... A63B 69/36

[52] U.S. Cl. ..... 273/186 C; 273/192

[58] Field of Search ..... 273/192, 186 C, 191 R, 273/35 R, 186 R, 183 R, 191; 172/656

[56] References Cited

U.S. PATENT DOCUMENTS

| | | | |
|---|---|---|---|
| 704,131 | 7/1902 | Sleeter | 172/656 X |
| 2,894,755 | 7/1959 | Scelzo | 273/192 |
| 3,868,116 | 2/1975 | Ford et al. | 273/186 C |
| 3,899,180 | 8/1975 | Rodman | 273/183 R |
| 4,413,826 | 11/1983 | Miller | 273/186 C |
| 4,423,875 | 1/1984 | Miller | 273/192 X |

FOREIGN PATENT DOCUMENTS

| | | | |
|---|---|---|---|
| 218526 | 5/1957 | Australia | 273/192 |

*Primary Examiner*—George J. Marlo

*Attorney, Agent, or Firm*—Richards, Harris, Medlock & Andrews

[57] ABSTRACT

A golf training aid (100; 140) is provided and includes first and second pairs of telescopically extendable rails (16, 18; 16', 18') and a pair of adjustable rails (102, 104; 142, 144). Screws (116, 130; 164, 166, 184, 186) adjust adjustable rails (102, 104; 142, 144) and maintain rails (16, 18; 16', 18') in an operational position and a folded storage position. Rails (102, 104) include pivotable members (106, 112, 120, 122) and rails (142, 144) include telescoping sections (152, 156, 158, 174, 176, 180).

6 Claims, 6 Drawing Figures

GOLF TRAINING AID

RELATED APPLICATIONS

This application is a continuation-in-part of U.S. patent application Ser. No. 06/409,418 filed Aug. 19, 1982 and now U.S. Pat. No. 4,423,875, issued Jan. 3, 1984 which is a continuation-in-part of U.S. patent application Ser. No. 06/398,112 filed July 14, 1982 and now U.S. Pat. No. 4,413,826, issued Nov. 8, 1983.

TECHNICAL FIELD

This invention relates to an improved golf training aid, and more particularly to a putting aid that is collapsible for easy storage in a golf bag.

BACKGROUND ART

The objective of all putting aids is to help the golfer develop and retain a superior putting stroke. Essentially, a superior putting stroke is one in which the putter blade follows the initial portion of the intended path to the cup. For short and medium putts, this is accomplished by stroking the putter straight back and straight through the initial portion of the intended path, while keeping the face of the putter blade perpendicular to the stroke path. For longer putts, a more pronounced backstroke and throughstroke is required whereby the putter blade is carried slightly inside the line of the stroke path at the extremes of the stroke. For all putts, however, the vertical distance between the ground and the bottom of the putter blade varies from essentially zero, at impact, to a few inches at the extremes of the stroke. This is known as keeping the putter blade low.

Previously developed putting aids have been designed to help the golfer develop a "straight back and straight through" putting stroke. Golfers have practiced by placing a pair of two-by-four boards parallel to one another and spaced apart a distance sufficient to accommodate a putter blade. The golfer would then practice putting while attempting not to contact the boards. It will, however, be readily appreciated that the use of two-by-fours on the golf course has several drawbacks. For example, the two-by-fours were inconvenient and cumbersome to carry around. It was also difficult to assure that the boards were parallel. Moreover, for longer putts, it was necessary to reposition the boards to provide a larger distance therebetween to allow the putter blade to be brought slightly inside the line in the back and throughstrokes.

Accordingly, several putting aids have developed stemming from the "two-board" concept that are lightweight and collapsible, thus, providing an advancement in convenience and portability over the two-by-four approach. Representative of these putting aids, for example, is U.S. Pat. No. 2,169,407 which provides a lightweight and collapsible putting aid utilizing a pair of parallel guides between which a golfer strokes the golf ball. However, the previously developed devices that are collapsible generally do not collapse to a size and configuration convenient for storage in the side pocket of a golf bag, and are complicated and difficult to assemble. Moreover, such devices do not provide putting aids with which both short and long putts may be practiced without having to readjust the distance between the parallel guides.

Accordingly, there is a need for an improved putting aid that is collapsible to a size and configuration convenient for storage in the side pocket of a golf bag, that is easy to assemble, and that may be used for practicing both short and long putts without having to readjust the distance between the putting guides.

DISCLOSURE OF THE INVENTION

In accordance with the present invention, a putting aid is provided that includes two pair of elongated, telescopically extendable rails and a pair of adjustable, collapsible rails interposed between the distal ends of the extendable rails.

The putting aid of the present invention is easy to assemble, yet is collapsible for storage in a convenient, unitary and rigid configuration.

BRIEF DESCRIPTION OF THE DRAWINGS

The present invention can be more completely understood by reference to the following Detailed Description taken in conjunction with the accompanying Drawings in which.

DETAILED DESCRIPTION

Figure 1:
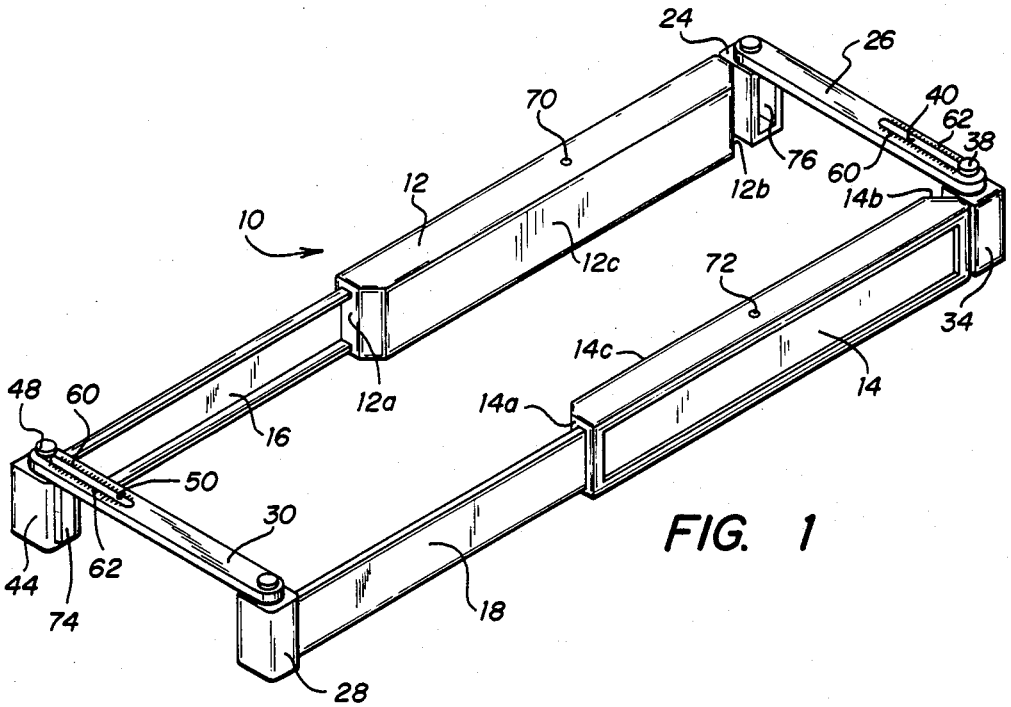
FIG. 1 is a perspective view of a putting aid in the extended operational position.
Figure 2:
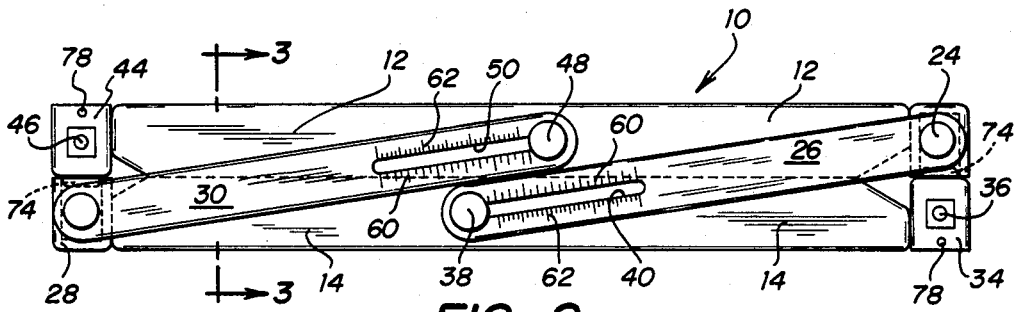
FIG. 2 is a top view of the putting aid shown in FIG. 1 in the folded stowed position.
Figure 3:
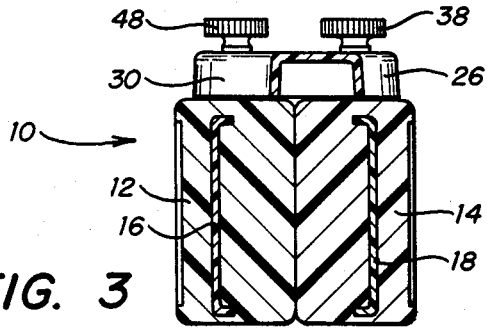
FIG. 3 is a cross section view taken generally along sectional lines 3—3 of FIG. 2.

Referring simultaneously to FIGS. 1, 2 and 3, a putting aid is illustrated and is generally identified by the numeral 10. Putting aid 10 includes a pair of elongated housing members 12 and 14. Slidably mounted within housing member 12 and exiting from end 12*a* of housing member 12 is an extension rail 16. Similarly, slidably mounted within housing member 14 and exiting from end 14*a* of housing member 14 is an extension rail 18. As is more clearly illustrated in FIG. 3, extension rails 16 and 18 are "U" shaped in cross section and are completely contained within housing members 12 and 14, respectively, in the folded stowed position of putting aid 10 as illustrated in FIG. 2.

Integrally connected to end 12*b* of housing member 12 is a swivel post 24 for pivotally supporting a slide rail 26. Slide rail 26 is movable between the extended operation position of putting aid 10 as illustrated in FIG. 1 to the folded stowed position illustrated in FIG. 2. Integrally interconnected to extension rail 18 is a swivel post 28 for pivotally supporting a slide rail 30. Slide rail 30 is movable in a manner similar to slide rail 26 between the extended operation position of putting aid 10 as illustrated in FIG. 1 to the folded stowed position as illustrated in FIG. 2.

Integrally interconnected to end 14*b* of housing member 14 is an end post 34 which includes a threaded aperture 36. Threaded aperture 36 receives a screw 38 which is carried by slide rail 26. Screw 38 is carried within an elongated slot 40 contained within slide rail 26.

Integrally interconnected to extension rail 16 is an end post 44 including a threaded aperture 46. Threaded aperture 46 receives a screw 48 which is carried by slide rail 30. Screw 48 is slidable within an elongated slot 50 within slide rail 30. It therefore can be seen that by positioning screws 38 and 48 within elongated slots 40 and 50 of slide rails 26 and 30, the spacing between housing members 12 and 14 in the extended operation position of putting aid 10 can be selectably changed. When the desired distance between housing members 12 and 14 is achieved, screws 38 and 48 are tightened to engage threaded apertures 36 and 46, respectively, such that a rectangular rigid structure is formed by slide rails 26 and 30 as ends and, extension rails 16 and 18 and housing members 12 and 14 as sides of putting aid 10.

Once putting aid 10 has been properly assembled by pivoting slide rails 26 and 30 perpendicularly to housing members 12 and 14 and extending extension rails 16 and 18 from housing members 12 and 14, the golfer adjusts the distance between housing members 12 and 14 so that there is sufficient space for the putter blade to pass therebetween with the putter blade oriented such that the face thereof is perpendicular to the interior walls **12*c* and 14*c* of housing members 12 and 14. In the preferred embodiment of the present putting aid 10, slide rails 26 and 30 are dimensioned such that the space between housing members 12 and 14 can be varied from approximately four inches to approximately seven inches to thereby accommodate a variety of putter blade sizes. The adjustment to accommodate varying sized putter blades is accomplished by loosening screws 38 and 48 within elongated slots 36 and 46 until the desired spacing is achieved. When this spacing is achieved, screws 38 and 48 are tightened such that slide rails 26 and 30 are rigidly attached to end posts 34 and 44**, respectively.

To assist the golfer in adjusting putting aid 10 so that housing members 12 and 14 are parallel, indicia 60 shown in inches and indicia 62 shown in centimeters are contained on slide rails 26 and 30 adjacent elongated slots 40 and 50. Using indicia 60 or 62, slide rails 26 and 30 can be adjusted so that the positioning of screw 38 in elongated slot 40 will lie at the same position as screw 48 within elongated slot 50.

As illustrated in FIGS. 2 and 3, putting aid 10 collapses to a size and configuration convenient for storage in a golf bag. To collapse putting aid 10, screws 38 and 48 are loosened such that slide rail 26 disengages from end post 34 and slide rail 30 disengages from end post 44. Extension rail 16 is telescopically inserted into housing member 12 and extension rail 18 is telescopically inserted into housing member 14. Housing members 12 and 14 are then brought into contact along their interior side walls **12*c* and 14*c* (FIG. 1) to permit slide rails 26 and 30 to pivot about swivel posts 24 and 28, respectively, to achieve the position illustrated in FIG. 2. After rotation of slide rails 26 and 30, screw 48 is positioned at the end of elongated slot 50 to engage a threaded aperture 70 (FIG. 1) contained within housing member 12 and screw 38 is positioned at the end of elongated slot 40 of slide rail 26 to engage a threaded aperture 72 (FIG. 1) contained within housing member 14. Upon tightening screws 38 and 48, housing members 12 and 14 are rigidly held together to maintain putting aid 10 in the folded stowed position illustrated in FIG. 2**.

In order to maintain extension rails 16 and 18 within housing members 12 and 14, respectively in the folded stowed position, end posts 34 and 44 include a locking boss 74 (FIG. 1) which is received by a recess 76 within swivel posts 24 and 28, respectively.

As illustrated in FIG. 2, end posts 34 and 44 include an aperture 78 for receiving a golf tee to thereby allow the user of putting aid 10 to secure putting aid 10 to the ground with the use of a pair of golf tees.

Figure 4:
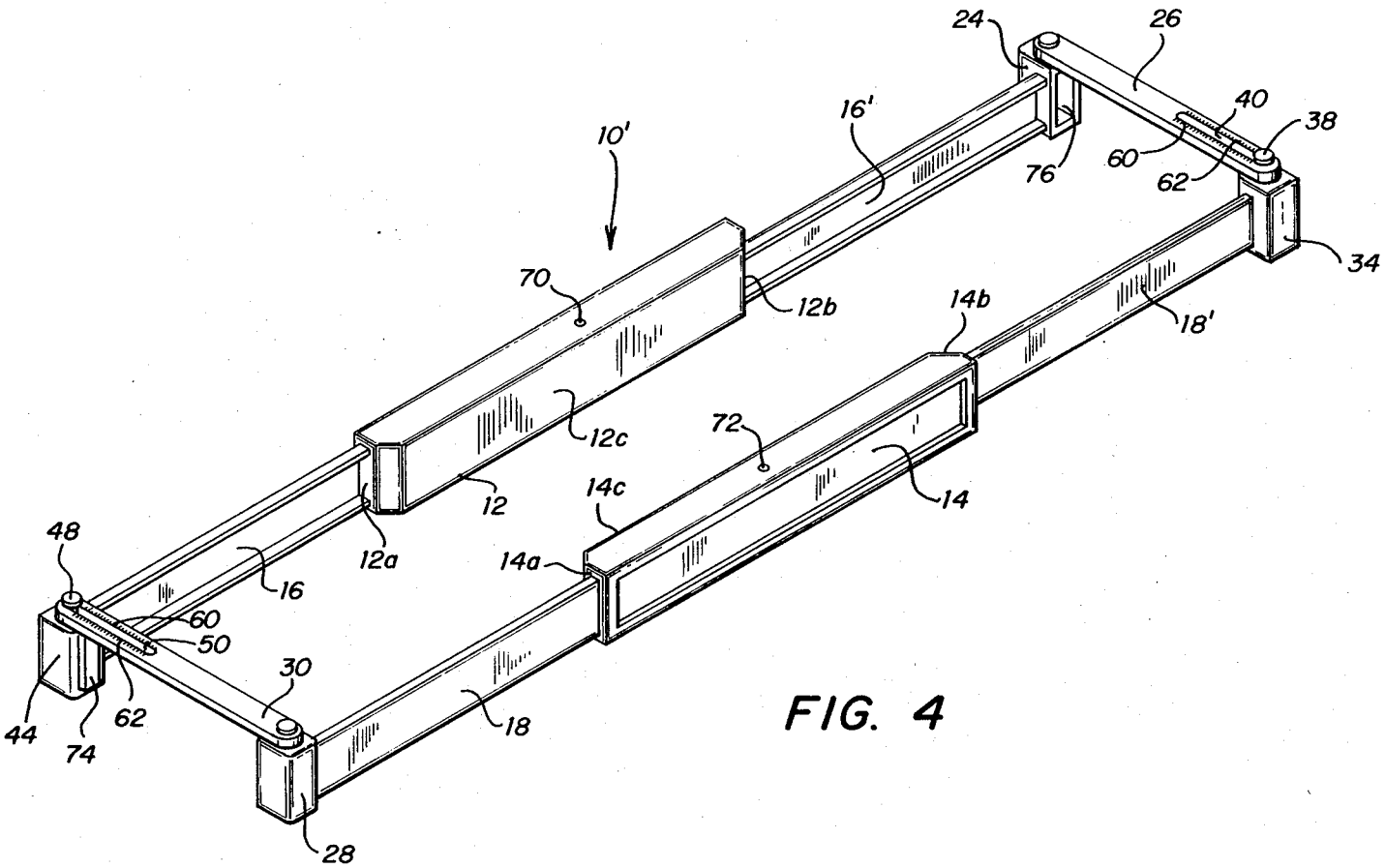
FIG. 4 is a perspective view of a putting aid in the extended operational position.

Referring now to FIG. 4, wherein like numerals are utilized for like and corresponding elements previously identified in FIGS. 1–3, a putting aid 10' is illustrated in the extended operation position. Putting aid 10' includes a second set of extension rails, 16' and 18', slidably mounted within housing members 12 and 14, respectively. Extension rails 16' and 18' exit ends **12*b* and 14*b* of housing members 12 and 14 similar to extension rails 16 and 18 which exit ends 12*a* and 14*a* of housing members 12 and 14 as shown in FIG. 1. Extension rail 16' is connected to swivel post 24 and extension rail 18' is connected to end post 34**.

Operation of putting aid 10' is similar to that of putting aid 10, and it can be seen that the length of putting aid 10' is approximately twice that of putting aid 10 for use in assisting the golfer on longer putts. Putting aid 10' collapses in a manner similar to putting aid 10. Extension rails 16' and 18' retract into housing members 12 and 14 in the stowed position.

Putting aid 10' may be used in practicing both short and long putts without the necessity of readjusting the distance between housing members 12 and 14 because the distance between slide rails 26 and 30 is greater than the distance between housing members 12 and 14. This aspect of the present invention makes it possible for the golfer to bring the putter slightly inside the line of the initial portion of the intended path to the cup on the back and through stroke which is necessary for longer putts. However, at the same time, putting aid 10 requires the golfer to stroke the putter between the interior walls **12*c* and 14*c* of housing members 12 and 14** through the critical portion of both short and long putts.

Figure 5:
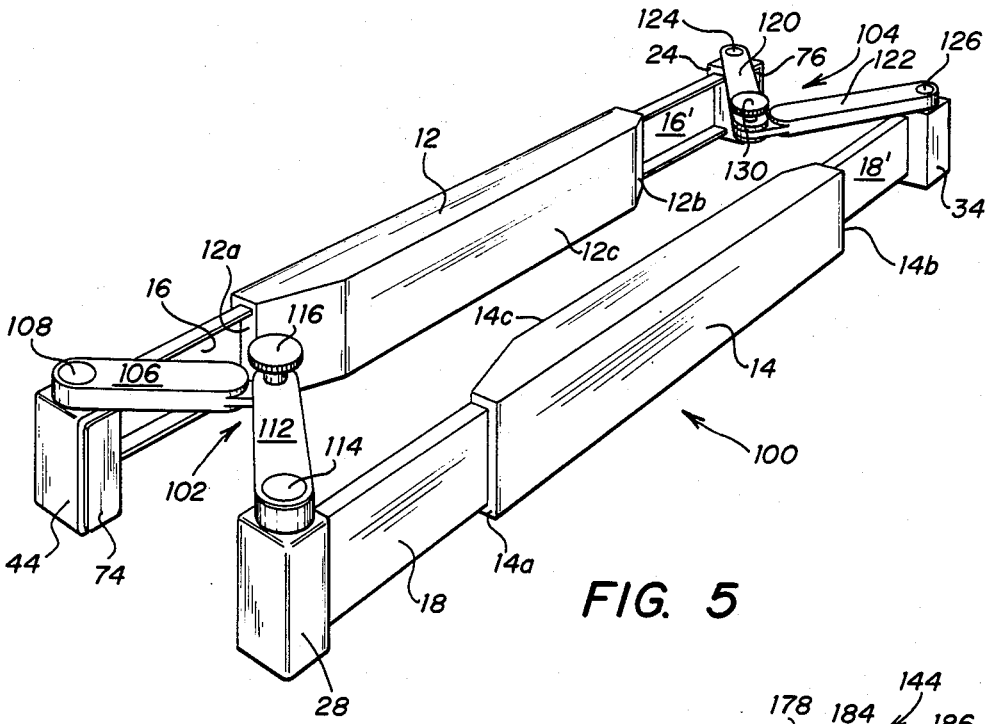
FIG. 5 is a perspective view of one embodiment of the putting aid of the present invention in the extended operational position.

Referring now to FIG. 5, wherein like numerals are utilized for like and corresponding elements previously identified in FIGS. 1–4, the present putting aid 100 is illustrated in the extended operation position. Putting aid 100 includes adjustable and collapsible rail assemblies 102 and 104 which function in a similar manner to slide rails 26 and 30 (FIG. 4) such that the space between housing members 12 and 14 can be varied to thereby accommodate a variety of putter blade sizes. Rail assembly 102 includes an arm 106 which is pivotally interconnected to end post 44 utilizing a screw 108. Alternatively, screw 108 may comprise a pin integrally formed with end post 44.

Rail assembly 102 further includes an arm 112 which is interconnected to swivel post 28 utilizing a screw 114. Alternatively, screw 114 may be replaced with a pin integrally molded to swivel post 28. Arms 106 and 112 are adjustably interconnected using a screw 116 which when tightened, maintains arms 106 and 112 in a fixed position.

Adjustable and collapsible rail assembly 104 is similarly configured to rail assembly 102. Rail assembly 104 includes arms 120 and 122. Arm 120 is pivotally connected to swivel post 24 using a screw 124. Arm 122 is pivotally connected to end post 34 using a screw 126. Interconnecting arms 120 and 122 is a screw 130.

Once putting aid 100 has been properly positioned by extending extension rails 16 and 16' from housing member 12 and by extending extension rails 18 and 18' from housing member 14, the golfer adjusts the distance between housing members 12 and 14 so that there is sufficient space for the putter blade to pass therebetween with the putter blade oriented such that the face thereof is perpendicular to the interior walls 12*c* and 14*c* of housing members 12 and 14. This adjustment is accomplished by loosening screws 116 and 130 of rail assemblies 102 and 104, respectively, to allow arms 106 and 112 of rail assembly 102 and arms 120 and 122 of rail assembly 104 to move in a scissors-like fashion. Rail assemblies 102 and 104 move inwardly and outwardly between housing members 12 and 14 to thereby decrease or increase the distance between interior walls 12*c* and 14*c* of housing members 12 and 14 until the desired spacing is achieved. When this spacing is achieved, screws 116 and 130 are tightened such that arms 106 and 112 of rail assembly 102 and arms 120 and 122 of rail assembly 104 are rigidly attached to thereby maintain the distance between housing members 12 and 14 at the desired spacing.

Putting aid 100 is collapsible to a similar configuration as illustrated in FIG. 2 with respect to putting aid 10 by loosening screws 116 and 130. In the collapsed position, arms 106 and 112 of rail assembly 102 lie approximately coincident. Similarly, arms 120 and 122 of rail assembly 104 also lie approximately coincident in the collapsed position of putting aid 100. Additionally, in the collapsed position, extension rails 16 and 16' are housed within housing member 12, and extension rails 18 and 18' are housed within housing member 14.

Figure 6:
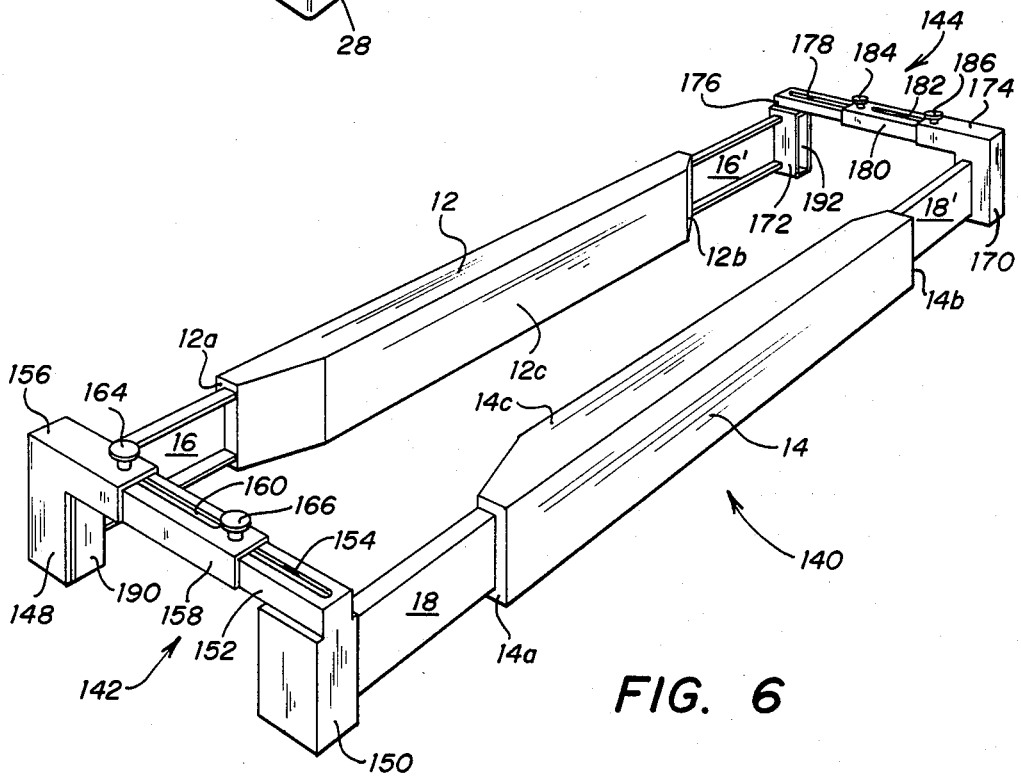
FIG. 6 is a perspective view of an additional embodiment of the putting aid of the present invention in the extended operational position.

Referring now to FIG. 6, wherein like numerals are utilized for like and corresponding elements previously identified in FIGS. 1–4, an additional embodiment of the present putting aid is illustrated and is generally identified by the numeral 140. Putting aid 140 includes adjustable telescoping rail assemblies 142 and 144. Rail assemblies 142 and 144 function to adjust the space between housing members 12 and 14 such that putting aid 140 can accommodate a variety of putter blade sizes.

Rail assembly 142 includes an end post 148 which is integrally interconnected to extension rail 16. Rail assembly 142 further includes an end post 150 which is integrally interconnected to extension rail 18. End post 150 includes an extension member 152 having a slotted aperture 154. End post 148 includes an extension member 156 for receiving a telescoping member 158. Telescoping member 158 includes a slotted aperture 160.

Telescoping member 158 receives extension member 152 of end post 150. A screw 164 is provided in extension member 156, and a screw 166 is provided in telescoping member 158. It therefore can be seen that the distance between housing members 12 and 14 can be selectively adjusted by positioning telescoping member 158 within extension member 156 and further by positioning extension member 152 within telescoping member 158. Once positioned, screws 164 and 166 are tightened to maintain the relationship between extension member 156, telescoping member 158 and extension member 152 in a fixed relative position.

Rail assembly 144 is configured in a similar manner to rail assembly 142. Rail assembly 144 includes an end post 170 which is integrally interconnected to extension rail 18'. An end post 172 is provided which is integrally connected to extension rail 16'. End post 170 includes an extension member 174. End post 172 includes an extension member 176. Extension member 176 includes a slotted aperture 178. Disposed between extension members 176 and 174 is a telescoping member 180. Telescoping member 180 includes a slotted aperture 182 and a screw 184. Extension member 174 includes a screw 186. It therefore can be seen that by positioning extension member 176 within telescoping member 180 and by positioning telescoping member 180 within extension member 174, the space between housing members 12 and 14 can be adjusted.

End posts 148 and 170 include a locking boss 190 which is received by a recess 192 within end posts 150 and 172, respectively for maintaining extension rails 16, 16', 18 and 18' within housing members 12 and 14 in the folded stowed position of putting aid 140.

The present putting aids 100 and 140 are lightweight in construction and can be fabricated by injection molding of plastic to provide for a durable and maintenance free structure.

It therefore can be seen that the present invention provides for a golf putting aid which is collapsible to a size and configuration convenient for storage in a golf bag as well as being easy to assemble for the practice of both short and long putts.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A golf training aid comprising:

first and second elongated telescopically extendable rail means each having first and second ends and being extendable to an operational position or retracted to a storage position;

first arm member having first and second ends, said first end being pivotally connected to said first end of said first elongated telescopically extendable rail means;

second arm member having first and second ends, said first end being pivotally connected to said first end of said second elongated telescopically extendable rail means;

said second ends of said first and second arm members being pivotally connected to thereby couple said first ends of said first and second elongated telescopically extendable rail means;

third arm member having first and second ends, said first end being pivotally connected to said second end of said first elongated telescopically extendable rail means;

fourth arm member having first and second ends, said first end being pivotally connected to said second end of said second elongated telescopically extendable rail means;

said second ends of said third and fourth arm members being pivotally connected to thereby couple said second ends of said first and second elongated telescopically extendable rail means;

said arm members being disposed between said first and second elongated telescopically extendable rail means, such that the spacing between said first and second elongated telescopically extendable rail means is selected by pivoting said first and second arm members with respect to each other and said third and fourth arm members with respect to each other to thereby maintain said first and second elongated telescopically extendable rail means in a preselected spaced apart relationship throughout the entire length of said first and second elongated telescopically extendable rail means in said operational position; and said arm members being disposed parallel to said first and second elongated telescopically extendable rail means in said storage position to enable the golf training aid to collapse to a compact configuration.

2. The golf training aid of claim 1 and further including:

lock means for connecting said second ends of said first and second arm members and lock means for connecting said second ends of said third and fourth arm members in said operational and said storage positions.

3. The golf training aid of claim 1 and further including:

boss means disposed in said first end of said first elongated telescopically extendable rail means; and said first end of said second elongated telescopically extendable rail means includes an aperture for receiving said boss means.

4. A golf training aid comprising:

first and second elongated telescopically extendable rail means each having first and second ends and being extendable to an operational position or retracted to a storage position;

first member having first and second ends, said first end being rigidly connected to said first end of said first elongated telescopically extendable rail means;

second member having first and second ends, said first end being rigidly connected to said first end of said second elongated telescopically extendable rail means;

third member for receiving said second ends of said first and second members, such that said third member is retractable within said first member and said second member is retractable within said third member to thereby couple said first ends of said first and second elongated telescopically extendable rail means;

fourth member having first and second ends, said first end rigidly connected to said second end of said first elongated telescopically extendable rail means;

fifth member having first and second ends, said first end being rigidly connected to said second end of said second elongated telescopically extendable rail means;

sixth member for receiving said second ends of said fourth and fifth members, such that said sixth member is retractable within said fourth member and said fifth member is retractable within said sixth member to thereby couple said second ends of said first and second elongated telescopically extendable rail means;

said members being disposed between said first and second elongated telespocially extendable rail means, such that the spacing between said first and second elongated telescopically extendable rail means is selected by telescoping said first, second and third members with respect to each other and said fourth, fifth and sixth members with respect to each other to thereby maintain said first and second elongated telescopically extendable rail means in a preselected spaced apart relationship throughout the entire length of said first and second elongated telescopically extendable rail means in said operational position; and said members being retracted in said storage position to enable the golf training aid to collapse to a compact configuration.

5. The golf training aid of claim 4 and further including:

lock means for connecting said first, second and third members and lock means for connecting said fourth, fifth and sixth members.

6. The golf training aid of claim 4 and further including:

boss means disposed in said first end of said first elongated telescopically extendable rail means; and said first end of said second elongated telescopically extendable rail means includes an aperture for receiving said boss means.

* * * * *

UNITED STATES PATENT AND TRADEMARK OFFICE

CERTIFICATE OF CORRECTION

PATENT NO. : 4,516,779

DATED : May 14, 1985

INVENTOR(S) : Gardner H. Miller

It is certified that error appears in the above-identified patent and that said Letters Patent is hereby corrected as shown below:

Column 8, line 2, after "end" (first occurrence), insert --being--.

Column 8, line 16, change "telespocially" to --telescopically--.

Signed and Sealed this

*Thirteenth* Day of *August 1985*

[SEAL]

*Attest:*

DONALD J. QUIGG

*Attesting Officer* *Acting Commissioner of Patents and Trademarks*